United States Patent [19]

Balchjunas et al.

[11] 4,441,055

[45] Apr. 3, 1984

[54] LIGHTING SYSTEM

[75] Inventors: Povilas I. Balchjunas, Vilnjus; Ionas J. Martinaitis, Kaunas; Sauljus A. Tulaba, Kaunas; Alfredas B. Pilkauskas, Kaunas, all of U.S.S.R.

[73] Assignee: Kaunassky Politekhnichesky Institut, Kaunas, U.S.S.R.

[21] Appl. No.: 354,095

[22] PCT Filed: May 29, 1981

[86] PCT No.: PCT/SU81/00048

§ 371 Date: Feb. 4, 1982

§ 102(e) Date: Feb. 4, 1982

[87] PCT Pub. No.: WO81/03731

PCT Pub. Date: Dec. 24, 1981

[30] Foreign Application Priority Data

Jun. 10, 1980 [SU] U.S.S.R. ..... 2938331
Jun. 10, 1980 [SU] U.S.S.R. ..... 2938327
Jun. 10, 1980 [SU] U.S.S.R. ..... 2937598

[51] Int. Cl.[3] ..... H05B 37/00

[52] U.S. Cl. ..... 315/288; 315/96; 315/256; 315/257; 315/189

[58] Field of Search ..... 315/96, 129, 130, 185, 315/189, 256, 282, 324, 288, 257

[56] References Cited

U.S. PATENT DOCUMENTS

| | | | |
|---|---|---|---|
| 335,060 | 0/1886 | Doubleday | 315/288 |
| 1,864,485 | 6/1932 | Eisenhut et al. | 315/285 |
| 1,907,030 | 5/1933 | Adam | 315/288 |
| 1,952,246 | 3/1934 | Hagelin | 315/256 |
| 2,030,434 | 2/1936 | Dorgelo | 315/256 |
| 2,205,476 | 6/1940 | Hunter | 315/288 |
| 2,297,258 | 9/1942 | Spanner | 315/256 |
| 3,054,991 | 9/1962 | Howell | 340/251 |
| 3,727,104 | 4/1973 | Neal et al. | 315/256 |
| 3,829,735 | 8/1974 | Berlock et al. | 315/189 |

FOREIGN PATENT DOCUMENTS

| | | |
|---|---|---|
| 892922 | 1/1952 | Fed. Rep. of Germany . |
| 2215743 | 8/1974 | France . |

*Primary Examiner*—Harold Dixon
*Attorney, Agent, or Firm*—Burton L. Lilling; Myron Greenspan; Bruce E. Lilling

[57] ABSTRACT

A lighting system comprises gaseous discharge lamps (8) connected to a source (1) of regulated alternating current through current transformers (5). The primary windings (6) of the current transformers (5) are connected in series to the source (1). The gaseous discharge lamps (8) are connected to the secondary windings (7) of the transformers (5).

The lighting system is designed for lighting industrial buildings, streets, highways, stadiums, mines, etc.

7 Claims, 11 Drawing Figures

LIGHTING SYSTEM

FIELD OF THE INVENTION

The present invention relates to lighting systems and more particularly to lighting systems employing gaseous discharge lamps.

The present invention may be used for lighting industrial buildings, streets, motor roads, stadiums, mines, etc.

BACKGROUND OF THE INVENTION

The gaseous discharge lamp is a light source in which light is produced by gas ionization brought about by an electric discharge. To initiate the discharge, the electrodes of a gaseous discharge lamp must be supplied with a rather high voltage (from hundreds to thousands of volts) capable of breaking through the gap between the electrodes to initiate ionization and gaseous discharge. Until the discharge occurs, a gaseous discharge lamp has a very high impedance, the current in the lamp being practically absent. After initiation of the discharge, current flows through the lamp and its impedance decreases. To prevent damage to the lamp, the current in the ignited lamp must be limited. It is common practice to use for this purpose a reactor connected in series with the lamp. If the lighting system comprises a plurality of gaseous discharge lamps, then each of them is usually connected to the supply source through a separate reactor. A parallel connection of gaseous discharge lamps through a common reactor cannot be tolerated because the initiation of ionization in one lamp leads to reduction in the lamp voltage and thus prevents the firing of the other lamps.

Known in the art is a lighting system comprising an alternating-current voltage source and gaseous discharge lamps each connected to the voltage source through a reactor (cf. a book by O. G. Bulatov, V. S. Ivanov and D. I. Panfilov "Tiristornye Skhemy Vkljucheniya Vysokointensivnykh Istochnikov Sveta", published by "Energiya", Moscow, 1975, page 39, FIG. 2–20).

The voltage which initiates ionization in a gaseous discharge lamp is several times greater than the voltage to be supplied to the lamp after ignition. Therefore the voltage at the reactor is usually 2 to 2.5 times greater than the voltage drop across the ignited lamp so that the reactor should be designed for a relatively great electric power, with the result that it is relatively great in weight and size. This, in turn, leads to significant power losses in the winding and core of the reactor. Besides, the presence of the reactor brings about deterioration in the power factor and thus necessitates the use of power factor compensating capacitors. As a result, the lighting fixtures have great weight and size.

To prevent the reactor from saturation during operation, its core must be provided with an air gap the presence of which, in case the core is improperly assembled, may cause "humming" of the reactor during operation. Therefore, the necessity to assemble a core with an air gap complicates the making of the reactor and thus increases the cost of the lighting system.

The voltage provided by the supply source may prove to be insufficient to fire a gaseous discharge lamp, especially when high-pressure gaseous discharge lamps are used, e.g. when a high-pressure sodium vapour lamp having an ignition voltage of 1 kilovolt is connected to an alternating-current network of 220 or 380 volts. In such cases it is necessary to have additional starting devices, such as thermal relays having their contacts connected across the lamps to provide upon their opening a sharp increase in the lamp voltage due to the e.m.f. of self-induction induced in the reactor (for low-pressure lamps), or special circuits generating pulses of high voltage sufficient to break through the gap between the electrodes (for high-pressure lamps). The need to employ additional starting devices complicates the lighting system. A similar problem arises when several gaseous discharge lamps are connected in series because the breakdown voltage increases approximately in proportion to the number of series-connected lamps.

The voltage applied to gaseous discharge lamps after ignition must not deviate significantly from the nominal value because even a relatively small increase in the voltage with respect to the nominal value leads to a sharp reduction in the service life of the lamp due to quick deterioration of the electrodes, whereas a relatively small reduction in the voltage makes the ignition of the lamp unreliable. The permissible value of deviation in the lamp voltage is usually no more than 5 to 7 percent. Because of this, variations in the output voltage of the alternating-current network supplying gaseous discharge lamps, occurring when the electrical devices connected to the network, including the lamps themselves, are switched on and off, adversely affect the operating reliability of the lighting system.

In case of a lighting system comprising a great number of gaseous discharge lamps consuming a large current from the supply source, substantial energy losses occur in the wires connecting the lamps to each other and to the supply source. The current consumed by the lamps and thus the energy losses may be reduced by providing a higher voltage from the supply source. In the known lighting systems this voltage, for safety reasons, cannot be greatly increased without substantial complication of the lighting system (e.g. by using step-down transformers), which creates relatively great energy losses in the lighting systems having a great number of lamps.

Besides, if in such lighting systems the wires connecting the lamps to each other have a great length, e.g. if the lighting system is intended for lighting streets or motor roads, the voltage in the lighting system, because of the voltage drop in the wires, will drop relatively quickly with increases in the distance from the transformer substation connecting a corresponding section of the lighting system to the power line. Since, as pointed out above, significant deviations of the voltage at a gaseous discharge lamp from the nominal value cannot be tolerated, the length of the section supplied from one substation will be relatively small, which makes it necessary to provide a great number of substations connecting such a lighting system to the power line, as a result of which the construction and maintenance costs are increased.

Also known in the art is a lighting system comprising an alternating-current voltage source and gaseous discharge lamps connected to the voltage source through an autotransformer (cf. U.S. Pat. No. 3,872,350 issued Mar. 18, 1975). In such a lighting system the windings of the autotransformer are magnetically loosely coupled to each other in order to provide a rise in the voltage at the transformer output when the lamps are being switched on, which is necessary to initiate gaseous discharge, and to provide reduction in the lamp voltage after ignition.

The employment of an autotransformer makes it possible to reduce its rated power in comparison with the reactor. However, because of the loose magnetic coupling between the transformer windings, this power remains significantly (about 70 to 80 percent) greater than the power consumed by the lamps connected to the transformer. Therefore, in such a system the lighting fixtures still have relatively great size and weight. The loose magnetic coupling between the windings may be achieved by providing an air gap in the transformer core, which complicates the making of the transformer, or by increasing the length of the magnetic circuit between the core portions at which the transformer windings are wound, which leads to a substantial increase in the transformer size and weight. Besides, the loose coupling between the transformer windings strongly deteriorates the power factor thus necessitating the use of power factor compensating capacitors.

The employment of an autotransformer provides a certain increase in the voltage supplied to the lamps when ionization is initiated, which makes it possible to connect two low-pressure lamps to the secondary winding of one transformer. However, in order to achieve a further increase in the voltage applied to the lamps at ignition, it is necessary to use additional starting devices. Besides, to provide ignition of two lamps by one transformer, one of them must be shunted by a capacitor, which complicates the lighting system.

In the case of a lighting system having a plurality of gaseous discharge lamps connected to the supply source through a plurality of parallel-connected autotransformers, variations in the supply voltage, as in the case of a lighting system with current-limiting reactors, will adversely affect the operating reliability of the lighting system. The energy losses in the wires of the lighting system in such a case will be also relatively great because, for safety reasons, the voltage of the supply source cannot be increased without substantial complication of the lighting system. If in such a lighting system the wires connecting the lamps have a great length, the voltage in the lighting system, as in a lighting system employing current-limiting reactors, will relatively quickly fall with increases in the distance from a transformer substation so that a great number of substations is required and the construction and maintenance costs are increased.

The principal object of the present invention is to provide a lighting system, which should be made so as to reduce its size, weight and cost and to increase at the same time the voltage applied to the gaseous discharge lamps at ignition without the use of additional starting devices, to reduce the current consumed in the lighting system at a rated load without adding complexity to the system, and to eliminate the influence of the resistance of the connecting wires and of load variations on the voltage supplied to each of the lamps after ignition, thereby decreasing weight, size and cost of lighting fixture, increasing reliability of lighting system operation, and reducing energy losses and construction and maintenance costs for lighting systems in which the wires connecting the lamps to one another have a considerably length.

SUMMARY OF THE INVENTION

With this principal object in view, there is provided a lighting system comprising an alternating-current supply source and gaseous discharge lamps connected to the supply source by means of transformer coupling, wherein, according to the invention, the supply source is a source of regulated alternating current and the gaseous discharge lamps are connected to the supply source through current transformers having their primary windings connected in series to the supply source, with the gaseous discharge lamps being connected to the secondary windings of the current transformers.

Each of the current transformers employed in such a lighting system is designed for power approximately equal to that consumed by the gaseous discharge lamps connected to its secondary winding so that the size and weight of each transformer is considerably smaller than the size and weight of the current limiting elements used in the known lighting systems. The employment of current transformers does not lead to deterioration in the power factor, which eliminates the need to use special power factor compensating capacitors. Since there is no need to provide air gaps in the cores of the current transformers, the manufacture of the lighting fixtures is simplified. Besides, the employment of current transformers supplied from a source of regulated alternating current makes it possible to obtain very high voltages at the transformer secondary windings under no-load conditions without the use of additional starting devices, with the result that a greater number of gaseous discharge lamps can be connected in series to the secondary winding of each transformer. Thus the present invention allows reduction in the size, weight and cost of lighting fixtures. By supplying the lamps with regulated alternating current, the influence of the wire resistance and load variations on the voltages applied to the lamps is practically eliminated, which ensures a more reliable operation of the lighting system and makes it possible to lengthen the section of the lighting system which can be supplied from one substation and thus to reduce the construction and maintenance costs for lighting systems wherein the wires connecting the lamps to one another have a great length. In the proposed lighting system the maximum value of the voltage at the output of the supply source may be very large, with the voltage between the wires to which the lighting fixtures are connected being rather small, which allows reduction in the current flowing in the lighting system under nominal load conditions and thus ensures smaller energy losses in the system wires.

According to one embodiment of the invention, the supply source comprises a serial circuit including two inductors and having its one terminal connected to a three-phase alternating-current power network through saturable reactors connected in a star configuration and its other terminal connected to the three-phase alternating-current power network through inductive impedance means and capacitive impedance means connected in series. In this case the series-connected primary windings of the current transformers are connected across the first inductor, and the supply source further comprises a switching circuit connected across the second inductor, a switching circuit control device for opening and closing the switching circuit during each half-cycle of the alternating voltage applied to the second inductor, and a current deviation sensing device responsive to the deviation of the current flowing in the primary windings of the current transformers from an assigned value and connected to the switching circuit control device for adjusting the time periods during which the switching circuit remains in the open and closed positions in response to deviation of the current in the primary windings of the current transformers from the assigned value.

In such a case the primary windings of the current transformers may be connected to the first inductor through a matching transformer whose primary winding is formed by the first inductor.

According to another embodiment of the invention, the supply source comprises two half-bridge thyristor invertors connected in parallel to a direct-current power network, with the commutation inductors connected in series with the thyristors shunted by diodes connected in antiparallel relation to the thyristors, the series-connected primary windings of the current transformers are connected between the junction of the arms of one inverter and the junction of the arms of the other inverter, the thyristor firing means of the inverters is arranged so that the firing pulses supplied to the thyristors of one inverter are shifted in phase with respect to the firing pulses supplied to the thyristors of the other inverter by an angle corresponding to the signal at the control input of the thyristor firing means, and the supply source further comprises a current deviation sensing device responsive to the deviation of the current flowing in the primary windings of the current transformers from an assigned value and connected to the control input of the thyristor firing means.

According to yet another embodiment of the invention, the supply source comprises a direct-coupled frequency converter which includes two thyristor rectifier circuits connected in antiparallel relation and the output of which is the output of the supply source, alternating-current voltage producing means for developing at one of its outputs an alternating-current voltage shifted in phase with respect to the voltage developed at its other output by an angle corresponding to the signal at the control input of the alternating-current voltage producing means and having its outputs connected in series to the output of the frequency converter, a signal control device for controlling the signal at the control input of the alternating-current voltage producing means to periodically vary the phase shift between the voltages at the outputs of the alternating-current voltage producing means with a frequency much smaller than the frequency of these voltages and in the range from a first limit value at which the voltage at the input of the frequency converter is zero to a second limit value at which the voltage at the input of the frequency converter is not zero, and a current deviation sensing device responsive to the deviation of the current flowing in the primary windings of the current transformers from an assigned value and connected to the signal control device for adjusting the second limit value of the phase shift in response to deviation of the current in the primary windings of the current transformers from the assigned value. In this case the thyristor firing means of the rectifier circuits of the frequency converter is synchronized with the signal control device and by the voltage at the input of the frequency converter for switching, with a frequency equal to the frequency of the voltage at the input of the frequency converter, the thyristors of one rectifier circuit when the phase shift between the voltages at the outputs of the alternating-current voltage producing means varies from the first limit value to the second limit value and the thyristors of the other rectifier circuit when the phase shift between the voltages at the outputs of the alternating-current voltage producing means varies from the second limit value to the first limit value.

The alternating-current voltage producing means may comprise two thyristor inverters connected to a direct-current power network, with the outputs of the inverters constituting the outputs of the alternating-current voltage producing means. The thyristor firing means of the inverters are provided in this case with a control input constituting the control input of the alternating-current voltage producing means and is arranged so that the firing pulses supplied to the thyristors of one inverter are shifted in phase with respect to the firing pulses supplied to the thyristors of the other inverter by an angle corresponding to the signal at the control input of the thyristor firing means.

According to another embodiment of the invention, the alternating-current voltage producing means comprises a thyristor inverter connected to a direct-current power network, with the output of the inverter constituting one output of the alternating-current voltage producing means, and an adjustable phase shifting device the input of which is connected to the output of the inverter, the control input of the phase shifting device constituting the control input of the alternating-current voltage producing means, while the output of the phase shifting device constitutes the other output of the alternating-current voltage producing means.

The present invention will become more apparent upon consideration of the following detailed description of its embodiments taken in conjunction with the accompanying drawings.

DESCRIPTION OF THE PREFERRED EMBODIMENTS

Figure 1:
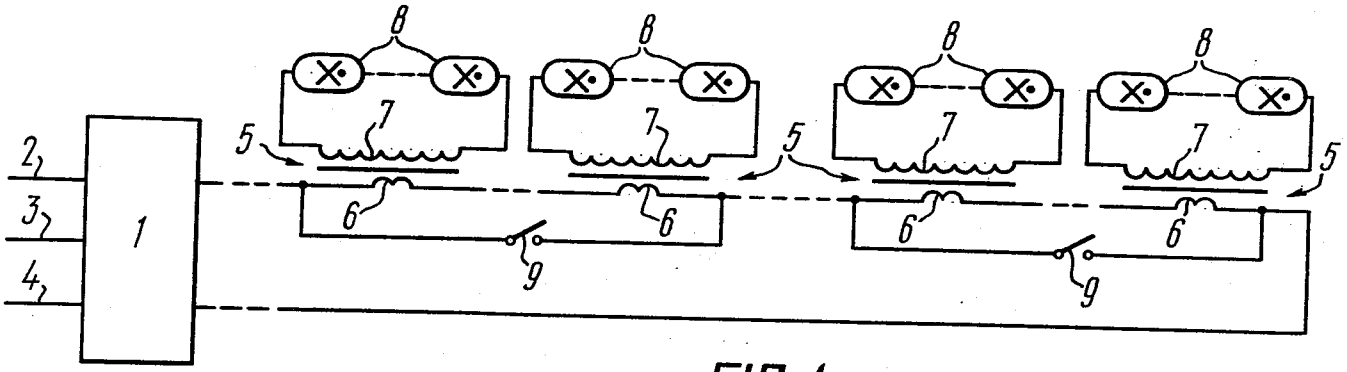
FIG. 1 is a schematic diagram of a lighting system, according to the present invention.

Referring to FIG. 1, the lighting system comprises a supply source formed by a source 1 of regulated alternating current connected to the conductors 2, 3 and 4 of a three-phase alternating-current power network. The source 1 may be installed at a substation connecting the lighting system to a power line. The lighting system further comprises a plurality of current transformers 5 having their primary windings 6 connected in series to the regulated current source 1. Several gaseous discharge lamps 8 are connected in series to the secondary winding 7 of each transformer 5. Switches 9 are connected in parallel with the primary windings 6 of the transformers 5 to switch on and off the lamps 8.

The transformers 5 are conventional-type current transformers wherein the secondary winding has a great number of turns, while the primary winding has a few turns or is formed by a conductor passing through an opening in the core on which the secondary winding is wound. The gaseous discharge lamps 8 may be low-pressure lamps (luminescence lamps) or high-pressure lamps (e.g. sodium or mercury vapour lamps).

Figure 2:
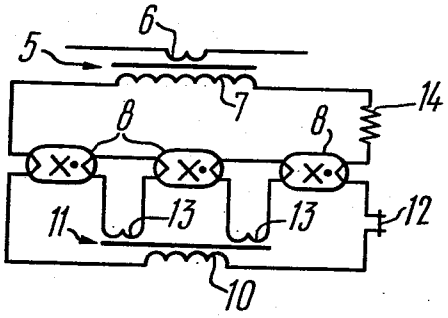
FIG. 2 is a schematic diagram showing how gaseous discharge lamps with heated electrodes are connected into the lighting system of the present invention.

When low-pressure lamps with heated electrodes are used, the heating of the electrodes, necessary for firing such lamps, may be accomplished with the aid of a time delay relay and a heating transformer, e.g. as shown in FIG. 2 according to which the primary winding 10 of a heating transformer 11 is connected in series with the contacts 12 of a thermal relay to the terminals of the lamp electrodes whose other terminals are connected to the ends of the secondary winding 7 of a current transformer 5. The secondary windings 13 of the heating transformer 11 are connected between the terminals of the lamp electrodes whose other terminals are connected to each other. The heater 14 of the thermal relay is connected in series with the secondary winding 7 of the transformer 5. If only a single lamp is connected to the secondary winding 7 of the current transformer 5, the heating transformer is not needed.

If all the switches 9 are closed, no current flows in the primary windings 6 of the transformers 5, the voltage at their secondary windings is zero and the lamps 8 are turned off. The current source 1 operates in such a case under short-circuit conditions and the voltage at its output is close to zero, while a regulated alternating current having an assigned value flows (via the switches 9) in the system wires. To prevent the flow of current through the wires of the lighting system when all the lamps 8 are turned off, the source 1 can be provided with a circuit breaker (not shown) disconnecting the source 1 from the conductors 2, 3 and 4 of the power network. This circuit breaker can be switched on and off by means of a control device (not shown) installed at the substation or by remote control with the aid of a control device (not shown) located in separate areas lighted by the gaseous discharge lamps 8.

The switching on of the gaseous discharge lamps is accomplished by opening those of the switches 9 which are connected across the primary windings of the current transformers whose secondary windings are connected to the lamps being switched on. Due to the regulation provided by the current source 1, the current in the lighting system in such an event does not change and remains equal to the assigned value.

If gaseous discharge lamps with cold electrodes are used, then, since the resistance of the lamps at ignition is very large, the current in the secondary windings of the current transformers connected to the lamps being switched on is practically zero. However, the current in the primary windings of these transformers does not change because the current source 1 maintains this current at the assigned level. Then, as a result of saturation of the magnetic circuits, a voltage corresponding to no-load conditions is induced in the secondary windings of the current transformers. The amplitude of this voltage, depending on the transformation ratio and the parameters of the cores of the transformers, achieves from several hundred to several thousand volts. This voltage ensures breakdown and firing of the gaseous discharge lamps connected to the secondary windings of corresponding current transformers.

If gaseous discharge lamps with heated electrodes are used, then, when one of the switches 9 is opened, the secondary windings of the corresponding current transformers are loaded with a very small resistance constituted by the resistance of the heater 14 (FIG. 2) and of the lamp electrodes, i.e. these current transformers operate close to short-circuit conditions. If the remaining switches 9 (FIG. 1) are closed at this time, the source 1 operates in this case close to short-circuit conditions, the voltage at its output is small and the current in the primary windings of said current transformers remains at the assigned level. After a time period sufficient for the heating of the lamp electrodes, the flow of current through the heater 14 of the thermal relay (FIG. 2) causes its contacts 12 to open the heating circuit. As a result, the load resistance of the corresponding current transformer sharply increases to a very high value of the resistance of the unignited lamps connected thereto, which leads to a sharp increase in the voltage at the secondary winding of this current transformer and to ignition of the lamps connected to this winding. Because of the inertia of the heater 14 the contacts 12 have no time to close before the lamps are ignited. After ignition the contacts 12 are held in the open position by the current passing through the ignited lamps.

After the lamps are fired, their resistance drops. Since viriation in the lamp resistance does not affect the current in the primary windings 6 of the transformers 5 (FIG. 1), which is maintained by the source 1 at a constant level, the current which flows through the ignited lamps is determined only by the transformation ratio of the transformers 5 and by the assigned value of the current, which are chosen so as to provide lamp voltages ensuring operation of the lamps under optimum conditions.

An increase or decrease in the number of the ignited lamps leads, respectively, to an increase or decrease in the voltage at the output of the source 1 but has no effect on the operation of the lamps because the voltages thereacross remain stable owing to a constant value of the current in the primary windings 6 of the transformers 5. This ensures reliable firing, as well as a maximum service life, of the gaseous discharge lamps and thereby a highly reliable operation of the lighting system. The distance between the point at which a lamp is connected to the system and a transformer substation does not affect the voltage supplied to the lamp because the same current flows through the primary windings 6 of all the transformers 5. Therefore, in the case of a lighting system in which the wires connecting the lamps have a great length, the length of the section which can be supplied from one substation is very great, which makes it possible to reduce the total number of substations required to connect the lighting system to the power line and thus to reduce the construction and maintenance costs.

The lighting system described above provides a relatively low voltage at the secondary windings 7 of the transformers 5 upon ignition of the lamps and, at the same time, a rather high voltage at the output of the source 1, which output voltage may reach tens of kilovolts. This allows considerable reduction in the system current and thus in the energy losses occurring in the system wires.

To increase safety when the lighting system is used for lighting buildings, the transformers 5 may be located in separate rooms. In this case the switches 9 may be remotely controlled thyristor circuits. To ensure safety during lamp changes, the transformers 5 may be provided with contacts (not shown) connected across their secondary windings 7, which contacts are closed during replacement of lamps. These contacts may be closed automatically upon removal of a lamp from the lighting fixture.

The switches 9 may be substituted by switches connected in parallel with the secondary windings 7 of the transformers 5. These switches may also be remotely controlled.

Each of the current transformers 5 should be designed for a power approximately equal to that consumed by the lamps connected to its secondary winding. Therefore these transformers have a small size and weight. Besides, they are simple in manufacture because their cores have no air gaps. The employment of current transformers produces no significant reduction in the power factor because the equivalent impedance of the circuit including a current transformer and the gaseous discharge lamps connected thereto is resistive in its effect. Therefore power factor compensating capacitors are not needed. All this allows reduction in the weight and size of lighting fixtures and in the cost of the lighting system.

Because of the high voltage developed at the secondary windings of the current transformers when the lamps are being switched on, several series-connected low-pressure or high-pressure lamps (e.g. two high-pressure lamps or four low-pressure lamps) can be connected to these windings, which allows a corresponding reduction in the required number of the current transformers.

Because in the course of operation of the lighting system the load of the current source 1, depending on the number of ignited lamps, may vary between values oen of which is many times, e.g. hundreds or thousands of times, greater than the other, the source 1 of regulated alternating current must be designed so as to maintain in the lighting system a current which does not change significantly when the load varies over a wide range, e.g. when the operating conditions of the current source vary from nominal load conditions (when all the lamps are turned on) to close to short-circuit conditions (when a minimum number of lamps are turned on). Besides, to ensure normal operating conditions of a gaseous discharge lamp, namely, to prevent strong pulsations in the light flux, reduction in the luminous efficiency of the lamp or even its extinction, the alternating current flowing through the lamp must have a sufficiently small amplitude factor. Typically the amplitude factor must be not greater than 1.4, which corresponds to a current ranging in waveform from a sine to rectangular wave. Since the voltage at the secondary windings 7 of the transformers 5 varies proportionally with the variation rate of the current in their primary windings 6, this current may have a waveform ranging from a sine to triangular wave. Therefore the current source 1 should be designed so as to provide in the primary windings 6 of the transformers 5 a regulated current having the aforementioned waveform in the whole range of variations of the load resistance.

Figure 3:
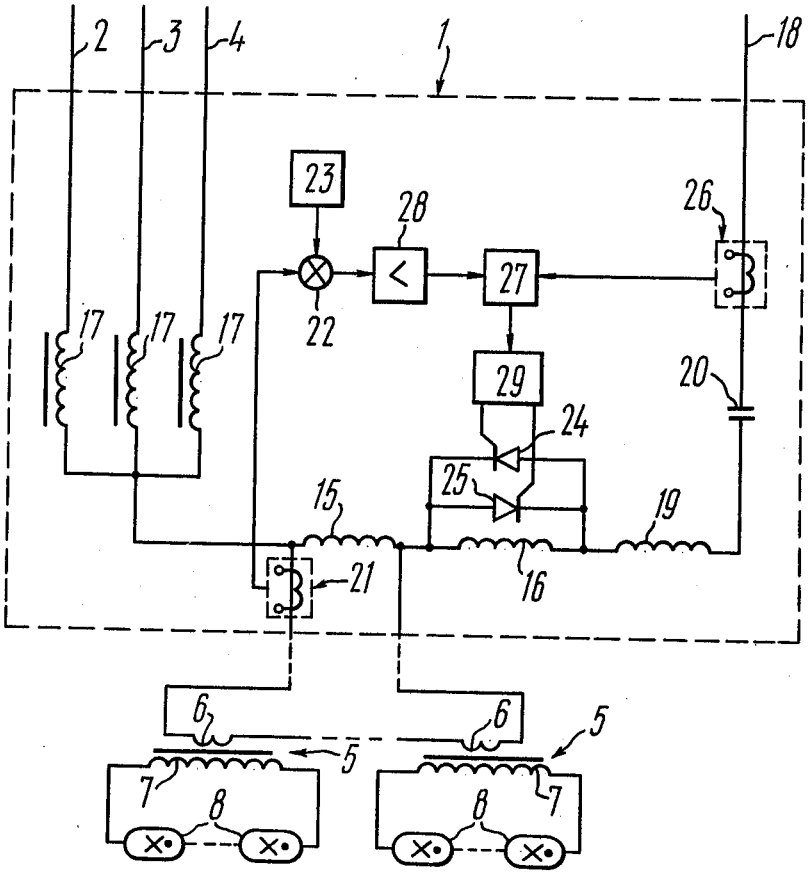
FIG. 3 is a schematic diagram of a supply source employed in the lighting system of the present invention and connected to a three-phase power network having a neutral wire.

FIG. 3 is a schematic diagram of one embodiment of the current source 1 which is capable of maintaining in the course of operation of the lighting system the assigned value of sinusoidal current in the primary windings 6 of the transformers 5.

Referring to FIG. 3, the source 1 of regulated alternating current comprises a serial circuit including two inductors 15 and 16. One terminal of the inductor 15 is connected to the phase conductors 2, 3 and 4 of a three-phase alternating-current power network through saturable reactors 17 connected in a star configuration, the other terminal of the inductor 15 being connected to one terminal of the inductor 16. The three-phase power network has a neutral conductor 18 connected to the other terminal of the inductor 16 through inductive impedance means constituted by an inductor 19 and capacitive impedance means connected in series with the inductor 19 and constituted by a capacitor 20.

The series-connected primary windings 6 of the transformers 5 are connected across the inductor 15.

The current source 1 further comprises a current deviation sensing device responsive to the deviation of the current in the primary windings 6 of the transformers 5 from an assigned value, a switching circuit connected across the inductor 16, and a switching circuit control device. The current deviation sensing device comprises a current sensor 21 connected in series with the primary windings 6 of the transformers 5, a comparison circuit 22 having its one input connected to the current sensor 21, and a setting unit 23 connected to another input of the comparison circuit 22. The switching circuit is composed of thyristors 24 and 25 connected in antiparallel relation to each other and across the inductor 16. The switching circuit control device comprises a current transformer 26 connected in series with the inductors 15 and 19 and the capacitor 20, an adjustable phase shifting circuit 27 having a synchronizing input connected to the output of the current transformer 26 and a control input connected to the output of the comparison circuit 22 through an amplifier 28, and a pulse shaper 29 having its input connected to the output of the phase shifting circuit 27 and its outputs connected to the control electrodes of the thyristors 24 and 25.

The current sensor 21 may be a current transformer. The adjustable phase shifting circuit 27 is adapted to produce at its output pulses having a repetition rate two times greater than the frequency of the sinusoidal signal at its synchronizing input and shifted in phase with respect to the latter by an angle corresponding to the value of the voltage at its control input so that the maximum value by which the phase shift between the pulses at the output of the phase shifting circuit and the signal at its synchronizing input may change in response to variation of the voltage at its control input is 180° (i.e. corresponds in time to the half-cycle of the signal at its synchronizing input). Such adjustable phase shifting circuits are well-known and widely used in thyristor converters. Such a phase shifting circuit may comprise, for example, a differential amplifier including two transistors and a capacitor connected into the collector circuit of one of the transistors, and a double-base diode having its control electrode supplied with a signal from the capacitor and its bases connected to the output of a full-wave rectifier whose input constitutes the synchronizing input of the phase shifting circuit. The signal controlling the phase shift provided by the phase shifting circuit is applied in such a case between the bases of the transistors of the differential amplifier. It is also possible to employ an adjustable phase shifting circuit comprising integrated analogue elements which include operational amplifiers. The pulse shaper 29 is adapted to produce, in accordance with the application of pulses to its input, short pulses having a steep leading edge and a power sufficient to fire the thyristors connected thereto. Such pulse shapers are well known and widely used in thyristor converters.

The source of regulated alternating current shown in FIG. 3 operates as follows.

The circuit composed of the reactors 17 operates as an ordinary frequency tripler. The flow of current through the reactors 17 leads to their periodic saturation, as a result of which the current flowing through the inductors 15, 16 and 19 and the capacitor 20 has a frequency which is three times greater than the frequency in the power network which supplies the current source 1. The frequency of the current in the inductors 15, 16 and 19 and the capacitor 20 may be, for example, 150 hertz.

When the load resistance connected across the inductor 15 is very small (a minimum number of lamps 8 are turned on), the equivalent impedance of the circuit composed of the inductor 15 and the load resistance is small as compared with the impedance of the circuit composed of the inductors 16 and 19 and of the capacitor 20. The values of the inductors 16 and 19 and of the capacitor 20 are chosen such that the capacitive reactance of the capacitor 20 is substantially greater than the total inductive reactance of the inductors 16 and 19 so that the total reactance of the circuit composed of these inductors and capacitor is capacitive in its effect. An increase in the load resistance (when additional lamps are switched on) leads to increase in the equivalent reactance of the circuit composed of the inductor 15 and the load resistance. Under relatively small loads this reactance rises rather quickly with increase in the load resistance, with the result that the capacitive reactance between the junction of the reactors 17 and the conductor 18 decreases as much causing the current in this circuit to increase. This increase in the current compensates for the increase in the load resistance preventing the current in the primary windings 6 of the transformers 5 from changing significantly.

Upon further increase in the load resistance the rate of growth of the equivalent reactance of the circuit constituted by the inductor 15 and the load resistance falls and does not provide sufficient compensation for the increase in the load resistance. However, the values of the inductors 15, 16 and 19 and of the capacitor 20 are chosen so that in such conditions the circuit composed of these elements approaches resonance at a frequency three times greater than the frequency in the power network, which leads to a substantial increase in the e.m.f. at the reactors 17 and thus in the current flowing between the junction of the reactors 17 and the conductor 18. This provides compensation for the increase in the load resistance, with the result that the current in the primary windings 6 of the transformers 5 is maintained at an assigned level.

The switching circuit composed of the thyristors 24 and 25 serves to compensate for variations in the output voltage of the power network. The setting unit 23 is set so that the signal at its output is equal to the signal at the output of the sensor 21, which corresponds to an assigned current value. The parameters of the phase shifting circuit 27 are chosen so that, when the signal at its control input is zero, the circuit 27 generates a pulse at its output when the instant value of current in the inductors 15, 16 and 19 and the capacitor 20, sensed by the current transformer 26, is zero. The application of pulses from the output of the phase shifting circuit 27 to the input of the pulse shaper 29 causes the latter to develop pulses alternately at its outputs so that the pulse trains produced at the outputs of the pulse shaper 29 are shifted in phase with respect to each other by 180° and so that, when the signal at the control input of the phase shifting circuit 27 is zero, the instants at which the control electrode of a thyristor is supplied with pulses coincide with the instants at which the anode potential of this thyristor becomes greater than its cathode potential. Thus, when the signal at the control input of the phase shifting circuit 27 is zero, the firing angle of each of the thyristors 24 and 25 is zero so that one thyristor is conducting during one half-cycle of the voltage applied to the inductor 16 and the other thyristor is conducting during the other half-cycle of this voltage. This corresponds to the closed position of the switching circuit, at which the inductor 16 is shunted all the time by the low resistance of an open thyristor and does not affect the output current of the source 1.

The application of voltage to the control input of the phase shifting circuit 27 leads to a delay in the development of pulses at its output and hence at the outputs of the pulse shaper 29, which delay is the greater the greater the voltage at the control input of the phase shifting circuit 27. In such a case the firing angles of the thyristors 24 and 25 differ from zero so that the inductor 16 is shunted by an open thyristor only during a part of each half-cycle of the voltage at the inductor 16. During the other part of each half-cycle of this voltage both the thyristors 24 and 25 are cut off, which corresponds to the open position of the switching circuit.

An increase in the output voltage of the power network leads to a slight increase in the current flowing through the primary windings 6 of the transformers 5, which increase is sensed by the sensor 21 and causes the error signal at the output of the comparison circuit 22 to increase. The change in the error signal is amplified by the amplifier 28 causing the phase shift in the phase shifting circuit 27, and hence the firing angle of the thyristors 24 and 25, to increase. As a result, the time periods during which the thyristors 24 and 25 are conducting become smaller, whereas the time periods during which the thyristors 24 and 25 are cut off become greater so that the average impedance of the circuit between the junction of the reactors 17 and the conductor 18 taken over the cycle of the current in this circuit increases compensating for the increase in the network voltage and thus preventing significant increase in the current flowing through the primary windings 6 of the transformers 5. When the voltage in the power network is at its maximum, the phase shift provided by the phase shifting circuit 27 is close to its maximum value corresponding to the half-cycle of the voltage at the inductor 16 so that the thyristors 24 and 25 are almost constantly cut off.

A decrease in the network voltage leads to a slight decrease in the current flowing through the primary windings 6 of the transformers 5, which causes the error signal at the output of the comparison circuit 22, and hence the phase shift in the phase shifting circuit 27 and the firing angle of the thyristors 24 and 25, to decrease. As a result, the time periods during which the thyristors 24 and 25 are conducting become greater, whereas the time periods during which the thyristors 24 and 25 are cut off become smaller so that the average impedance of the circuit between the junction of the reactors 17 and the conductor 18 taken over the cycle of the current in this circuit decreases compensating for the decrease in the network voltage and thus preventing significant decrease in the current flowing through the primary windings 6 of the transformers 5. When the voltage in the power network is at its minimum, the phase shift provided by the phase shifting circuit 27 is close to zero so that the thyristors 24 and 25 are almost constantly conducting.

The accuracy to which the assigned value of current is maintained is determined by the gain of the circuit including the current sensor 21, the comparison circuit 22, the amplifier 28 and the phase shifting circuit 27.

The inductor 19 provides suppression of the higher harmonics arising from saturation of the reactors 17. Because voltage fluctuations in the power network are usually small, e.g. constitute several persent of the nominal value, the inductance of the inductor 16 may be made small in comparison with that of the inductor 19. With such an inductance of the inductor 16, its periodic switching on and off caused by the switching of the thyristors 24 and 25 of the switching circuit does not lead to substantial distortions in the shape of the current provided by the source 1. Thus, the source of regulated alternating current shown in FIG. 3 ensures sinusoidal current waveform in the primary windings 6 of the current transformers 5.

The switching circuit composed of thyristors 24 and 25 may be substituted by other controlled switching circuits which provide periodic shunting of the inductor 16.

Figure 4:
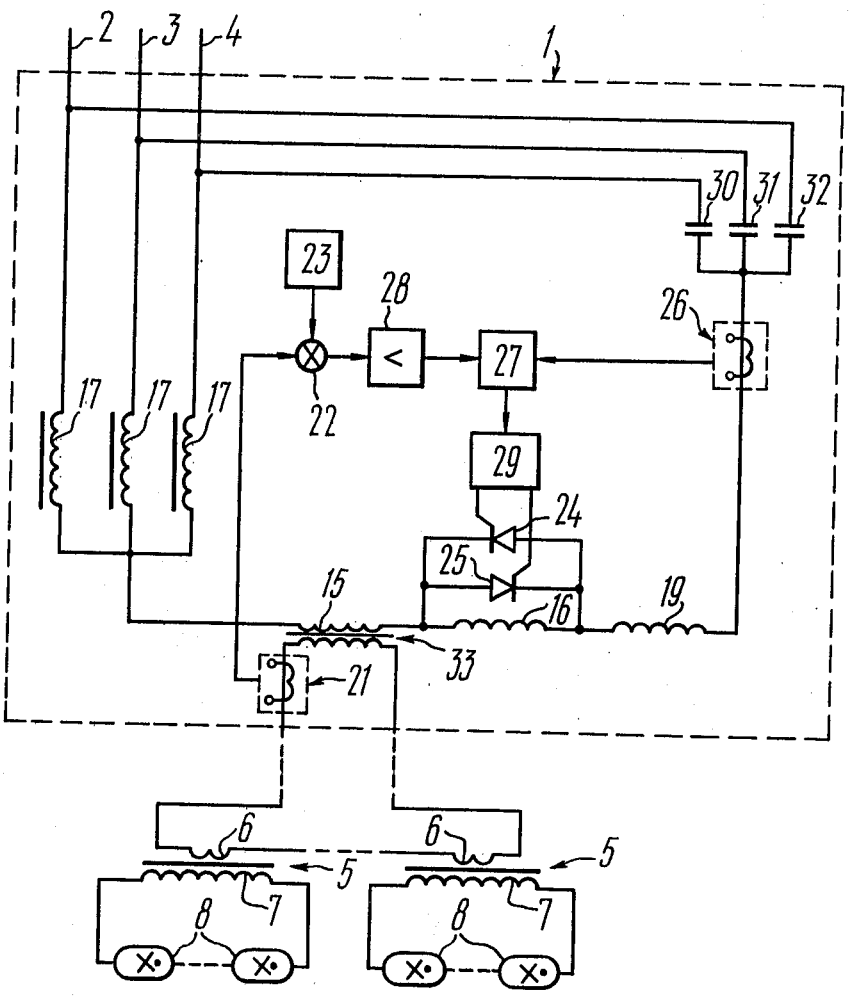
FIG. 4 is a schematic diagram of a supply source similar in design to that shown in FIG. 3, further provided with a matching transformer and connected to a three-phase power network having no neutral wire.

If the three-phase power network has no neutral conductor, the inductors 15 and 16 may be connected to the network as shown in FIG. 4 according to which the capacitor 20 (FIG. 3) is substituted by three capacitors 30, 31 and 32 connected to the phase conductors 2, 3 and 4 as shown in FIG. 4. It is also possible to connect the inductors 15 and 16 through three inductors (not shown) used in place of the inductor 19 (FIG. 3) and respectively connected to the conductors 2, 3 and 4 of the power network in series with the capacitor 20 (FIG. 3) or with the capacitors 30, 31 and 32 (FIG. 4). In such cases the total capacity of the parallel-connected capacitors should be the same as the capacitance of the capacitor 20 in the circuit shown in FIG. 3 and the inductance of the circuit constituted by the parallel-connected inductors should be the same as the inductance of the inductor 19.

To facilitate the matching of the parameters of the gaseous discharge lamps 8 with those of the source 1, the lamps may be connected to be source 1 through a matching transformer as also shown in FIG. 4 according to which the series-connected primary windings 6 of the transformers 5 are connected to the source 1 through a matching transformer 33 whose primary winding is formed by the inductor 15.

The circuits shown in FIGS. 3 and 4 are capable of maintaining the current in the lighting system to an accuracy of 2% during variation of the voltage at the output of the current source from zero to 800 volts. The share of the higher harmonics in the current curve does not exceed 5 to 7 percent.

The circuits shown in FIGS. 3 and 4 are relatively simple and reliable in operation. Their efficiency, however, is relatively low (about 0.8) because of relatively great magnetic losses in the saturable reactors. Therefore, it is expedient to use such circuits when the power consumed in the lighting system is not very large, e.g. constitutes tens of kilowatts. With lighting systems having a large power consumption (e.g. hundreds of kilowatts), it is expedient to use a source of regulated alternating current having a higher efficiency, such as show in FIG. 5.

Figure 5:
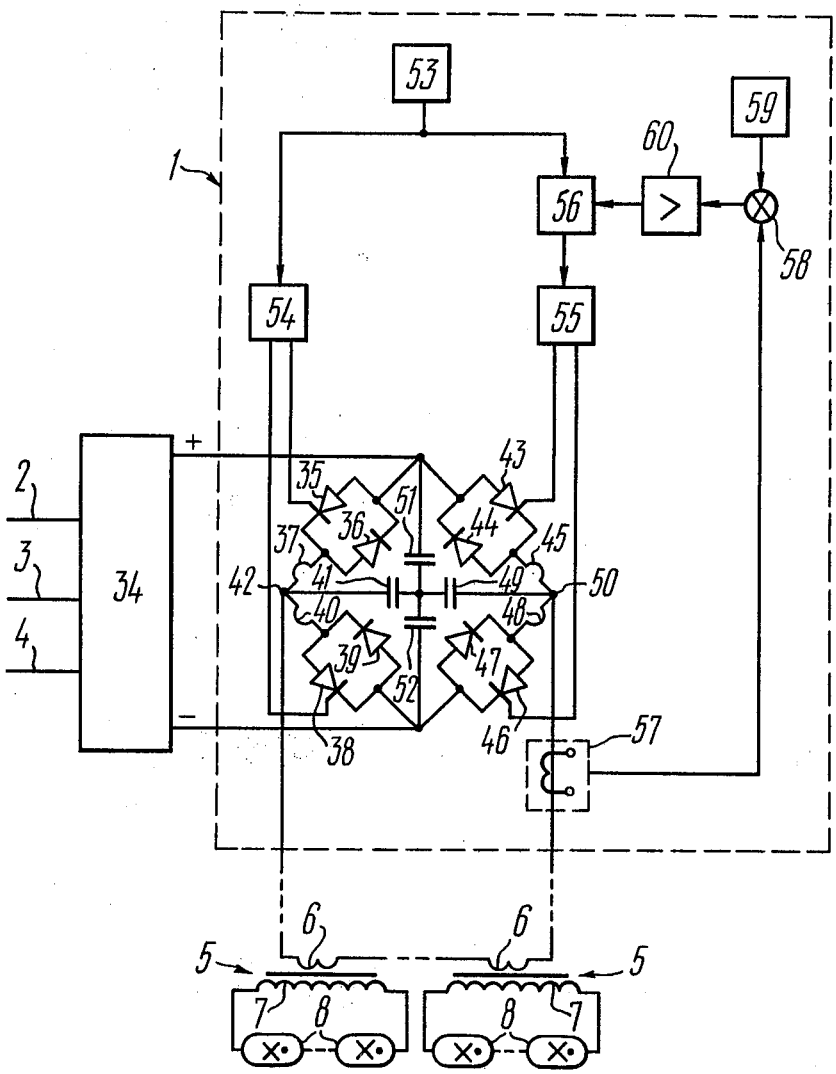
FIG. 5 is a schematic diagram of another embodiment of the supply source employed in the lighting system of the present invention, FIGS. 6(a–k), 7(a–k) and 8(a–k) show signal waveforms obtained at various positions in the circuit shown in FIG. 5 under different operating conditions.

Referring to FIG. 5, the source 1 of regulated alternating current comprises two half-bridge thyristor inverters connected in parallel to a direct-current power network, viz. to the output of a rectifier 34 having its input connected to the conductors 2, 3 and 4 of the three-phase alternating-current power network. Instead of the rectifier 34, the inverters may be connected to a direct-current generator or power line. One arm of one half-bridge inverter includes a thyristor 35 connected to the output of the rectifier 34 in a forward direction and shunted by a diode 36 connected in antiparallel relation, and a commutation inductor 37 connected in series with the parallel circuit formed by the thyristor 35 and the diode 36. The other arm of this inverter includes a thyristor 38 connected to the rectifier 34 in a forward direction and shunted by a diode 39 connected in antiparallel relation, and a commutation inductor 40 connected in series with the parallel circuit formed by the thyristor 38 and the diode 39. The inverter further comprises a commutation capacitor 41 having its one terminal connected to the junction point 42 of the inverter arms. The arms of the other half-bridge inverter include, respectively, a thyristor 43 a diode 44, a commutation inductor 45 and a thyristor 46, a diode 47, a commutation inductor 48 connected in the same manner as the thyristors 35 and 38, the diodes 36 and 39 and the commutation inductors 37 and 40. The second inverter further comprises a commutation capacitor 49 having its one terminal connected to the junction point 50 of the arms of the second inverter. The inverters are provided with a common voltage divider formed by capacitors 51 and 52 having large capacitances and connected in series to the output of the rectifier 34. The other terminals of the commutation capacitors 41 and 49 are connected to the junction of the capacitors 51 and 52.

The series-connected primary windings 6 of the current transformers 5 are connected between the junction point 42 of the arms of one inverter and the junction point 50 of the arms of the other inverter.

The inverters are provided with thyristor firing means comprising a sine-wave oscillator 53, a pulse shaper 54 having its input connected to the output of the oscillator 53 and its outputs respectively connected to the control electrodes of the thyristors 35 and 38, a pulse shaper 55 having its outputs respectively connected to the control electrodes of the thyristors 43 and 46, and an adjustable phase shifting circuit 56 having a synchronizing input connected to the output of the oscillator 53, an output connected to the input of the pulse shaper 55 and a control input forming a control input of the thyristor firing means. The phase shifting circuit 56 may be designed similar to the phase shifting circuit 27 (FIG. 3).

The source 1 (FIG. 5) further comprises a current deviation sensing device responsive to the deviation of the current in the primary windings 6 of the transformers 5 from an assigned value and including a current sensor 57 connected in series with the primary windings 6 of the transformers 5, a comparison circuit 58 having its one input connected to the sensor 57, and a setting unit 59 connected to another input of the comparison circuit 58 the output of which is connected through an amplifier 60 to the control input of the phase shifting circuit 56.

During operation of the current source 1, the pulse shaper 54 develops at its outputs pulse trains shifted in phase with respect to one another by 180°. This pulse trains are respectively applied to the control electrodes of the thyristors 35 and 38. The pulse shaper 55 also develops two pulse trains shifted in phase with respect to each other by 180° and respectively applied to the control electrodes of the thyristors 43 and 46. The repetition rate of the pulses developed by the pulse shapers 54 and 55 is the same as the frequency of the oscillator 53. The phase angle by which the pulse trains produced by the pulse shaper 54 are shifted with respect to the pulse trains produced by the pulse shaper 55 is determined by the phase shift provided by the phase shifting circuit 56, which phase shift is, in turn, determined by the signal at its control input.

Upon application of a pulse to the control electrode of the thyristor 35 the latter becomes conductive, as a result of which the commutation capacitor 41 is charged through the circuit including the thyristor 35, the inductor 37 and the capacitor 52. Because of the inductor 37, the capacitor 41 is charged to a voltage higher than the voltage at the capacitor 51 causing thereby the thyristor 35 to turn off, whereupon the capacitor 41 begins to discharge through the diode 36. Then a pulse is supplied to the control electrode of the thyristor 38, as a result of which this thyristor is fired and the capacitor 41 is recharged through the thyristor 38 and the inductor 40. Thanks to the presence of the inductor 40, the capacitor 41 is charged to a a voltage higher than that at the capacitor 52 causing thereby the thyristor 38 to turn off, whereupon the capacitor 41 begins to discharge through the diode 39. Then a pulse is supplied to the control electrode of the thyristor 35 whereby the capacitor 41 is recharged again and the process described above is repeated. As a result, a sinusoidal voltage is developed at the capacitor 41, the frequency of this voltage being equal to that of the oscillator 53. In a similar way a sinusoidal voltage is developed at the capacitor 49 the recharging of which results from alternate firing of the thyristors 43 and 46. The voltage between the junction points 42 and 50 of the arms of each inverter applied to the series-connected primary windings 6 of the current transformers 5 will represent the sum of the voltages at the capacitors 41 and 49.

Figure 6:
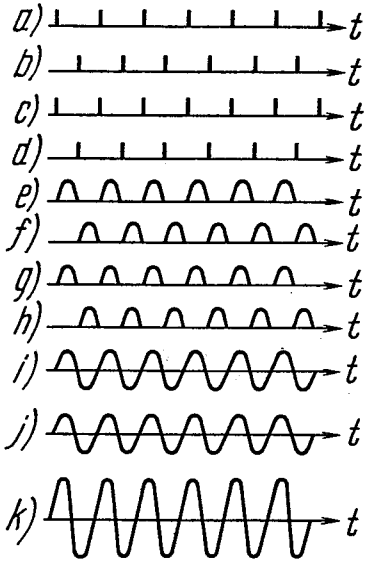

If the pulses at the control electrode of the thyristor 43 appear simultaneously with the pulses applied to the control electrode of the thyristor 38 and the pulses at the control electrode of the thyristor 46 appear simultaneously with the pulses applied to the control electrode of the thyristor 35, the sinusoidal voltages at the capacitors 41 and 49 are in phase so that the amplitude of the voltage between the points 42 and 50 equals the sum of the voltage amplitudes at the capacitors 41 and 49, as illustrated in FIG. 6 wherein graphs *6a*, *6b*, *6c* and *6d* show, respectively, the pulses applied to the control electrodes of the thyristors 35, 38, 46 and 43, graphs *6e*, *6f*, *6g* and *6h* show, respectively, variations of the currents in these thyristors, graphs *6i* and *6j* show, respectively, variations of the voltages at the capacitors 41 and 49, and graph *6k* shows the voltage between the points 42 and 50.

Figure 7:
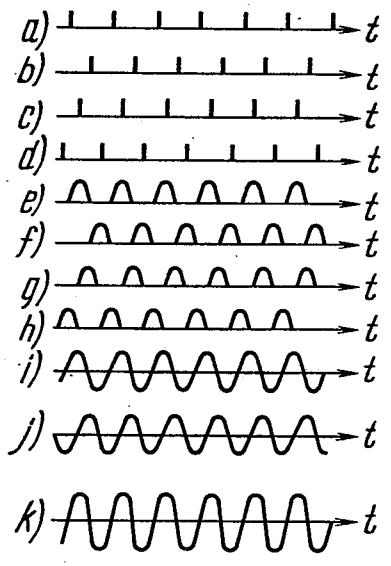
Figure 8:
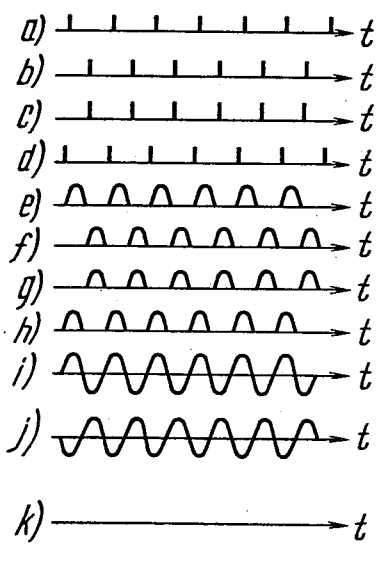

If the pulse trains produced by the pulse shaper 54 are shifted in phase by a certain angle with respect to the pulse trains produced by the pulse shaper 55, i.e. the control electrodes of the thyristors 43 and 46 are supplied with pulses during time intervals between the instants of application of pulses to the control electrodes of the thyristors 35 and 38, the sinusoidal voltages at the capacitors 41 and 49 will be shifted in phase by the same angle so that the amplitude of the voltage between the points 42 and 50 will be smaller than the sum of the voltage amplitudes at the capacitors 41 and 49, as illustrated in FIG. 7 wherein graphs *7a*–*7k* show variations of the same signals as the graphs in FIG. 6 designated by the same letters. The voltage amplitude between the points 42 and 50 will be the less, the greater is the phase shift between the pulses supplied to the control electrodes of the thyristors 35 and 38, on the one hand, and, respectively, the pulses supplied to the control electrodes of the thyristors 46 and 43, on the other hand. If this phase shift is 180°, i.e. the pulses at the control electrode of the thyristor 43 appear simultaneously with the pulses applied to the control electrode of the thyristor 35 and the pulses at the control electrode of the thyristor 46 appear simultaneously with the pulses applied to the control electrode of the thyristor 38, the voltages at the capacitors 41 and 49 are opposite in phase and compensate for each another so that the voltage between the points 42 and 50 is zero, as illustrated by FIG. 8 wherein graphs *8a*–*8k* show variations of the same signals as the graphs in FIG. 6 designated by the same letters.

The regulation of the current flowing in the primary windings 6 of the transformers 5 is accomplished as follows.

The parameters of the rectifier 34 and of the half-bridge inverters are chosen such that, when the control electrodes of the thyristors 43 and 46 are supplied with pulses simultaneously with the pulses respectively supplied to the control electrodes of the thyristors 38 and 35 and the voltage in the alternating-current power network has a minimum vlaue, the summation voltage between the points 42 and 50 is sufficient to provide the assigned value of current in the primary windings 6 of the transformers 5 when the maximum number of lamps are turned on (under maximum load conditions). The setting unit 59 is set so that the signal at its output is equal to the signal at the output of the current sensor 57, which corresponds to the assigned current value. The parameters of the phase shifting circuit 56 are chosen so that, when the signal at its control input is zero, the phase shift between the pulses developed at its output and the signal at the output of the oscillator 53 is such that the control electrodes of the thyristors 43 and 46 are supplied with pulses simultaneously with the application of pulses to the control electrodes of the thyristors 38 and 35, respectively.

With a minimum voltage in the power network and a maximum number of the ignited lamps, the error signal at the output of the comparison circuit 58, and hence the signal at the control input of the phase shifting circuit 56, has a minimum value so that the instants of application of firing pulses to the thyristors 43 and 46 approximately coincide, respectively, with the instants of application of firing pulses to the thyristors 38 and 35, the phase shift between the voltages at the capacitors 41 and 49 is close to zero and the summation voltage between the points 42 and 50 has a maximum value. An increase in the network voltage or a decrease in the load, i.e. in the number of ignited lamps, leads to a slight increase in the current flowing through the primary windings 6 of the transformers 5, which is sensed by the current sensor 57 and causes the error signal at the output of the comparison circuit 58 to increase. The change in the error signal is amplified by the amplifier 60 bringing about an increase in the phase shift provided by the phase shifting circuit 56 and thus in the phase shift of the firing pulses applied to the thyristors 43 and 46 with a respect to the firing pulses applied to the thyristors 38 and 35. As a result, the phase shift between the voltages at the capacitors 41 and 49 also increases preventing significant increase in the current flowing through the windings 6. A drastic decrease in the load from its maximum value causes the pulses produced by the phase shifting circuit 56 to shift by a time interval approximately equal to the half-cycle of the signal at the output of the oscillator 53. When the load is small, the instants of application of firing pulses to the thyristors 43 and 46 are close, respectively, to the instants of application of firing pulses to the thyristors 35 and 38, the phase shift between the voltages at the capacitors 41 and 49 is close to 180°, and the voltage between the points 42 and 50 is close to zero, i.e. the source 1 operates close to short-circuit conditions.

Thus, the source 1 of regulated alternating current shown in FIG. 5 is capable of maintaining the current flowing through the primary windings 6 of the transformers 5 at an assigned level under variations in the power network voltage, as well as under drastic changes in the load resistance occurring when the number of the ignited lamps is varied. The accuracy to which the assigned value of current is maintained is determined by the gain of the circuit including the current sensor 57, the comparison circuit 58, the amplifier 60 and the phase shifting circuit 56. Since the voltage between the points 42 and 50 represents a sum of the sinusoidal voltages at the capacitors 41 and 49, the voltage at the output of the current source 1 has a sinusoidal form irrespective of the load resistance.

The frequency of the sinusoidal voltage between the points 42 and 50 supplied to the gaseous discharge lamps 8 is the same as the frequency of the oscillator 53 and can be rather high (e.g. several kilohertz), which will ensure a small weight and size of the reactive elements in the inverters and of the transformers 5 and, besides, provides reduction in the pulsations of the light flux.

Figure 11:
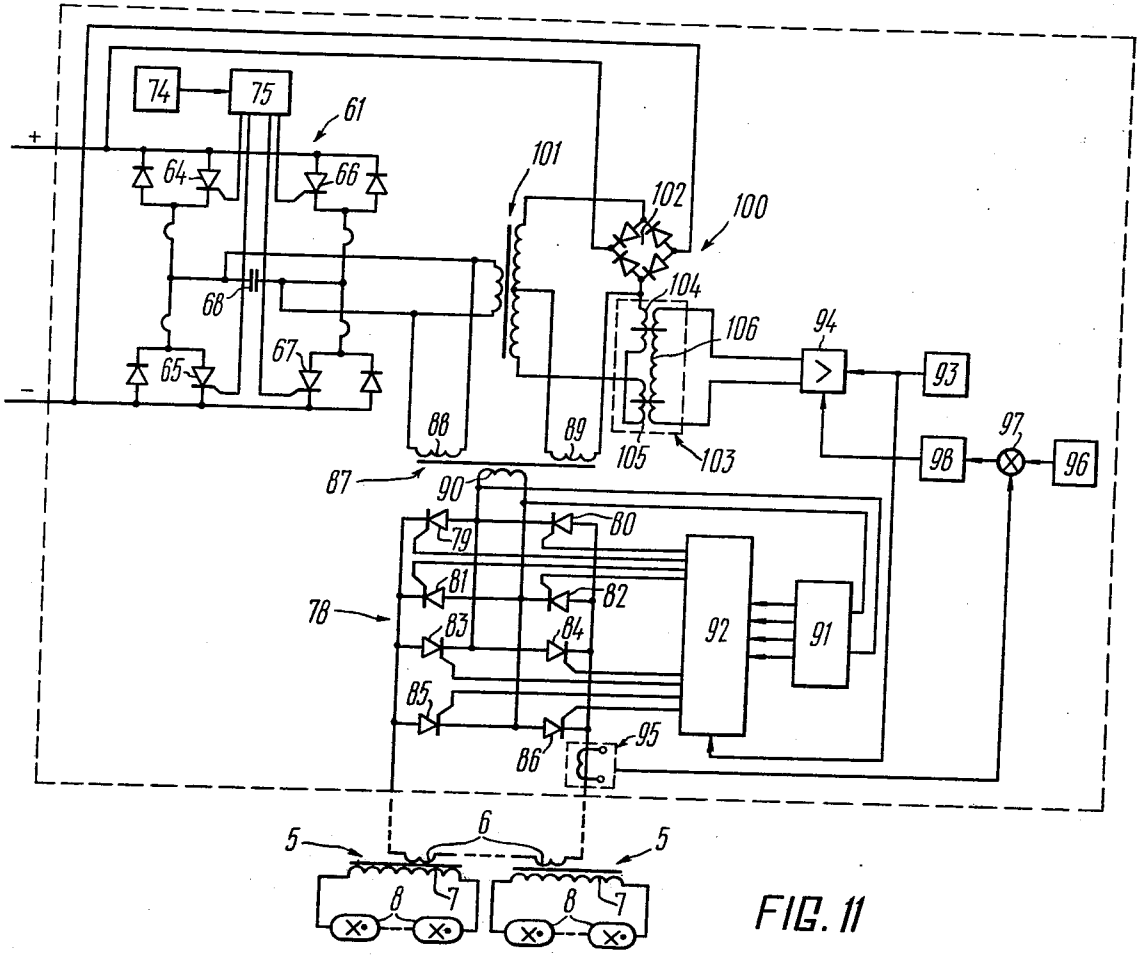
FIG. 11 is a schematic diagram of still another embodiment of the supply source employed in the lighting system of the present invention.

It is inexpedient to use low-frequency pulses for switching the thyristors in the circuit shown in FIG. 5 because to provide low-frequency switching of great currents which flow in a powerful lighting system it would be necessary to use commutation capacitors and inductors having a very great weight and size. On the other hand, in the case of a powerful lighting system wherein the wires connecting the lamps have a great length, e.g. if the lighting system is used for lighting streets or motor roads, a great frequency of the supply current leads to substantial deterioration in the power factor because of the great inductance of the wires. This necessitates tbhe use of compensating systems which, because of the high power consumed in the lighting system, prove to be very complicated. At the same time, the pulsations of the light flux in such lighting systems are generally of little importance. Therefore it is expedient to use in this case a source of regulated alternating current incorporating a direct-coupled frequency converter which provides high power output but has no reactive commutation elements. Such a source may be made as shown in FIG. 9 or 11.

Figure 9:
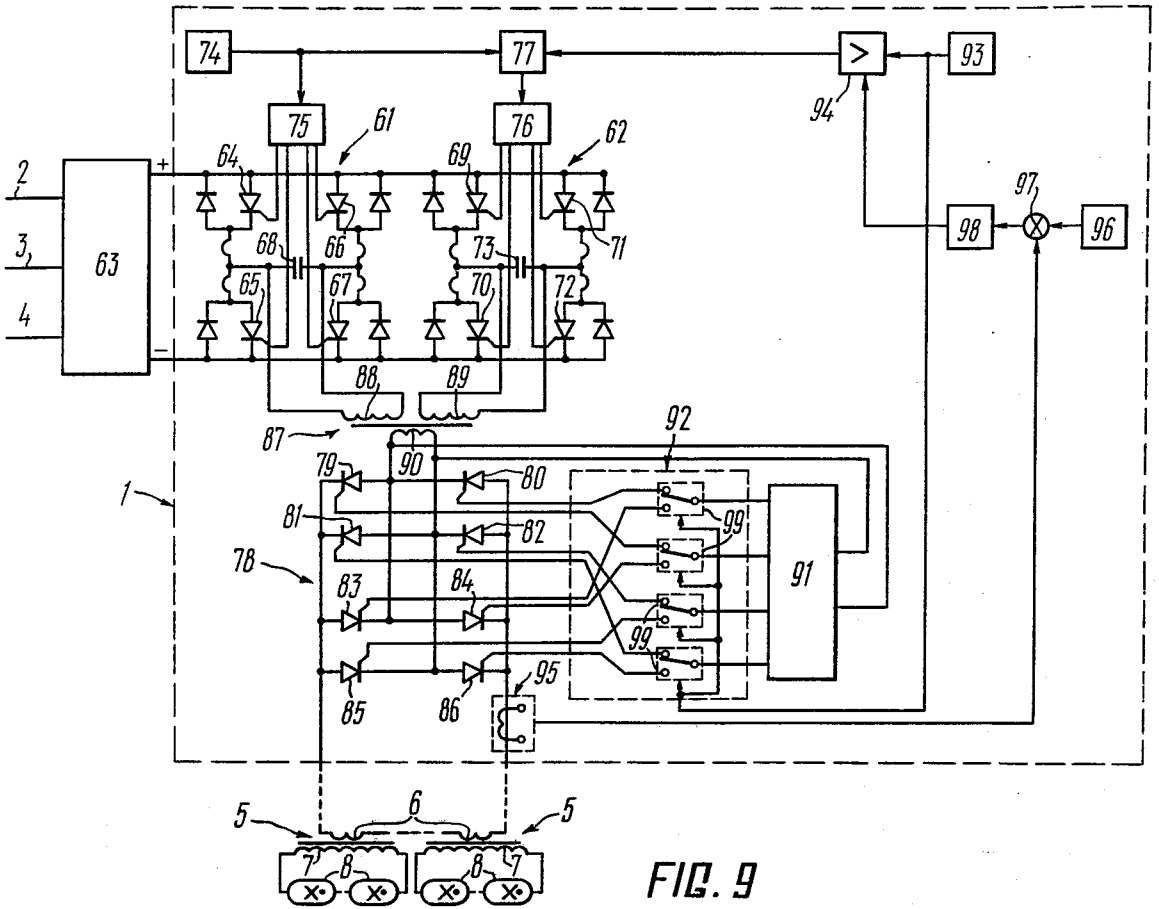
FIG. 9 is a schematic diagram of yet another embodiment of the supply source employed in the lighting system of the present invention.

Referring to FIG. 9, the source 1 of regulated alternating current comprises alternating-current voltage producing means including two bridge thyristor inverters 61 and 62 connected in parallel to a direct-current power network, viz. to the output of a rectifier 63 having its input connected to the conductors 2, 3 and 4 of the three-phase alternating-current power network, the outputs of the inverters 61 and 62 constituting the outputs of the alternating-current voltage producing means.

The inverters 61 and 62 do not differ in design from conventional-type bridge thyristor inverters. The inverter 61 has four arms two of which respectively include thyristors 64 and 65 and are connected in series to the output of the rectifier 63, while the other two arms respectively include thyristors 66 and 67 and also connected in series to the output of the rectifier 63. Each of the inverter arms further comprises a commutation inductor connected in series with the thyristor of this arm, and a diode connected in antiparallel relation to the thyristor. A commutation capacitor 68 is connected between the junction of the arms comprising the thyristors 64 and 65 and the junction of the arms comprising the thyristors 66 and 67. The output signal of the inverter 61 is derived from the capacitor 68. The inverter 62 comprises thyristors 69, 70, 71 and 72, commutation inductors, diodes and a commutation capacitor 73 connected in the same way as the thyristors 64, 65, 66 and 67, the commutation inductors, the diodes and the commutation capacitor 68 of the inverter 61. The output signal of the inverter 62 is derived from the capacitor 73.

The inverters 61 and 62 are provided with thyristor firing means comprising a sine-wave oscillator 74, a pulse shaper 75 having its input connected to the output of the oscillator 74 and its outputs respectively connected to the control electrodes of the thyristors 64, 65, 66 and 67, a pulse shaper 76 having its outputs respectively connected to the control electrodes of the thyristors 69, 70, 71 and 72, an adjustable phase shifting circuit 77 having a synchronizing input connected to the output of the oscillator 74, an output connected to the input of the pulse shaper 76 and a control input forming a control input of the thyristor firing means.

The source 1 further comprises a direct-coupled frequency converter 78 including two thyristor rectifier circuits connected in antiparallel relation. One rectifier circuit includes thyristors 79, 80, 81 and 82, while the other includes thyristors 83, 84, 85 and 86. The anodes of the thyristors 79, 81, 84 and 86 are respectively connected to the cathodes of the thyristors 80, 82, 83 and 85. The cathodes of the thyristors 79 and 81 are connected to each other and to the interconnected anodes of the thyristors 83 and 85. The anodes of the thyristors 80 and 82 are connected to each other and to the interconnected cathodes of the thyristors 84 and 86. The junction between the anode of the thyristor 79 and the cathode of the thyristor 80 is connected to the junction between the cathode of the thyristor 83 and the anode of the thyristor 84. The junction between the anode of the thyristor 81 and the cathode of the thyristor 82 is connected to the junction between the cathode of the thyristor 85 and the anode of the thyristor 86. The outputs of the inverters 61 and 62 are connected in series to the input of the frequency converter 78 through a transformer 87 having its one primary winding 88 connected across the capacitor 68, its other primary winding 89 connected across the capacitor 73 and its secondary winding 90 connected with its one end to the interconnected anodes of the thyristors 79 and 84 and cathodes of the thyristors 80 and 83 and with its other end to the interconnected anodes of the thyristors 81 and 86 and the cathodes of the thyristors 82 and 85. The primary windings 88 and 89 have the same number of turns.

The frequency converter 78 is provided with thyristor firing means comprising a pulse shaper 91 having its input connected to the secondary winding 90 of the transformer 87 and its outputs connected through a switching device 92 to the control electrodes of the thryistors 79–86 of the frequency converter 78.

The series-connected primary windings 6 of the transformers 5 are connected to the output of the frequency converter 78 constituting the output of the source 1, i.e. between the junction of the cathodes of the thyristors 79 and 81 and the anodes of the thyristors 83 and 85 and the junction of the anodes of the thyristors 80 and 82 and the cathodes of the thyristors 84 and 86.

The source 1 further comprises a signal control device for controlling the signal at the control input of the phase shifting circuit 77. The signal control device is constituted by a generator which develops a periodic signal having an adjustable amplitude and includes a generator 93 adapted to produce a unipolar triangular periodic signal and a variable gain amplifier 94 having its input connected to the output of the generator 93 and its output connected to the control input of the phase shifting circuit 77. The source 1 further comprises a current deviation sensing device responsive to the deviation of the current in the primary windings 6 of the transformers 5 from an assigned value and including a current sensor 95 connected in series with the windings 6, a setting unit 96 and a comparison circuit 97 having its inputs connected to the current sensor 95 and to the setting unit 96 and its output connected through an amplifier 98 to the control input of the amplifier 94.

The pulse shapers 75, 76 and 91 and the phase shifting circuit 77 may be made similar to the pulse shapers 54 and 55 and to the phase shifting circuit 56 shown in FIG. 5. The switching device 92 (FIG. 9) comprises four electronic switches 99 connected between the control electrodes of the thyristors 79–86 and the outputs of the pulse shaper 91 so that the control electrodes of the thyristors 79 and 84 are connected to one output of the pulse shaper 91 through one electronic switch, the control electrodes of the thyristors 80 and 83 are connected to another output of the pulse shaper 91 through another electronic switch, the control electrodes of the thyristors 81 and 86 are connected to a third output of the pulse shaper 91 through a third electronic switch, and the control electrodes of the thyristors 82 and 85 are connected to a fourth output of the pulse shaper 91 through a fourth electronic switch. The control inputs of the electronic switches 99 are connected to each other forming a control input of the switching device 92. The generator 93 may consist of a bipolar triangular wave generating circuit and a full-wave rectifier connected thereto. Bipolar triangular wave generating circuits are well known and widely used in analogue computers.

The source 1 of regulated alternating current shown in FIG. 9 operates as follows.

The generator 93 develops a unipolar triangular signal of low frequency (e.g. 150 hertz), which signal varies from zero to a certain maximum value as shown in FIG. 10*a*. This signal is applied to the input of the amplifier 94 (FIG. 9) which develops at its output a triangular signal having the same waveform as the signal at the output of the generator 93 and an amplitude which varies in proportion to the signal at the control input of the amplifier 94.

Figure 10:
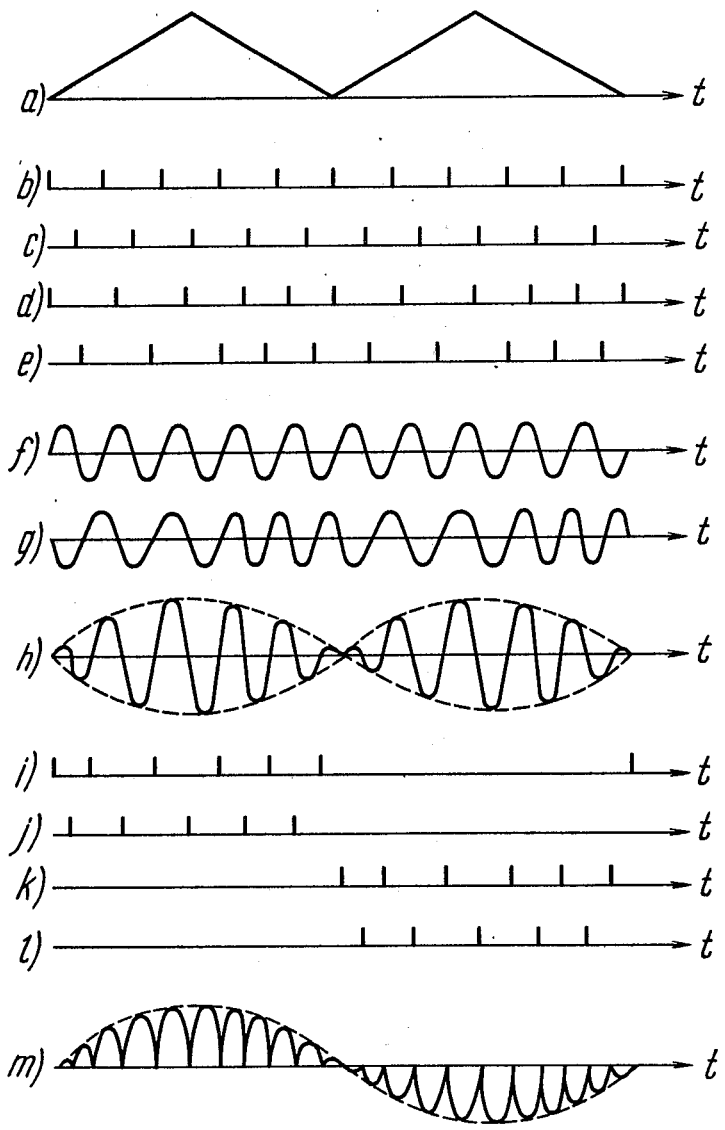
FIG. 10(a–m) shows signal waveforms obtained at various positions in the circuit shown in FIG. 9.

The inverters 61 and 62 operate as ordinary bridge thyristor inverters. The oscillator 74 develops a sinusoidal voltage having a relatively high frequency (e.g. 1000 hertz) which is much greater than the frequency of the periodic signal produced by the generator 93. The sinusoidal signal from the oscillator 74 is applied to the input of the pulse shaper 75 which develops at its outputs connected to the control electrodes of the thyristors 64 and 67 pulse trains which are in phase with each other and have a repetition rate equal to the frequency of the signal developed by the oscillator 74. Likewise, the pulse shaper 75 develops at its outputs connected to the control electrodes of the thyristors 65 and 66 pulse trains which are in phase with each other and have the same repetition rate as the pulses applied to the thyristors 64 and 67 but which are shifted in phase with respect to the latter pulses by 180°. The pulse trains applied to the control electrodes of the thyristors 64–67 are shown in FIG. 10 in which FIG. 10*b* corresponds to the pulses applied to the thyristors 64 and 67 and FIG. 10*c* corresponds to the pulses applied to the thyristors 65 and 66. As a result, a sinusoidal voltage is developed at the capacitor 68 (FIG. 9), the frequency of the voltage being equal to that of the oscillator 74. This voltage is applied to the primary winding 88 of the transformer 87 and is shown in FIG. 10*f*.

The inverter 62 (FIG. 9) operates similar to the inverter 61. The pulse shaper 76 develops at its outputs connected to the control electrodes of the thyristors 69 and 72 pulse trains which are in phase with each other and shifted in phase by 180° with respect to the in-phase pulse trains developed at its outputs connected to the control electrodes of the thyristors 70 and 71. The phase angle by which the pulse trains at the control electrodes of the thyristors 69–72 are shifted with respect to the pulse trains at the control electrodes of the thyristors 64–67 is determined by the signal at the control input of the phase shifting circuit 77. The latter is made so that, when the signal at its control input is zero, the phase shift between the pulses at its output and the signal at the output of the generator 74 is such that the application of pulses to the thyristors 69 and 72 coincides in time with the application of pulses to the thyristors 64 and 67 and the application of pulses to the thyristors 70 and 71 coincides with the application of pulses to the thyristors 65 and 66. The appearance of a signal from the amplifier 94 at the control input of the phase shifting circuit 77 leads to a change in the phase shift of the pulses at the control electrodes of the thyristors 69–72 with respect to the pulses at the control electrodes of the thyristors 64–67. The phase shifting circuit 77 provides variation of this phase shift in proportion to variation of the voltage at its control input, i.e. according to the linear variation of the signal at the output of the amplifier 94 so that said phase shift varies in the range from zero to a maximum value proportional to the amplitudes of the signal at the output of the amplifier 94. Thus the curve characterizing variation of said phase shift with time corresponds to FIG. 10*a* and the amplitude of this variation is determined by the signal at the control input of the amplifier 94 (FIG. 9).

The pulse trains applied to the control electrodes of the thyristors 69–72 are shown in FIG. 10 in which FIG. 10*d* corresponds to the pulses applied to the thyristors 69 and 72 and FIG. 10*a* corresponds to the pulses applied to the thyristors 70 and 71. A sinusoidal voltage is developed at the capacitor 73 of the inverter 62 (FIG. 9), which voltage has the same amplitude as the voltage at the capacitor 68 of the inverter 61 and is shifted in phase with respect to the voltage at the capacitor 68 by an angle which periodically and linearly varies in proportion to the signal at the output of the amplifier 94 as shown in FIG. 10*g*. The voltage developed at the capacitor 73 (FIG. 9) is applied to the primary winding 89 of the transformer 87.

The transformer 87 develops at its secondary winding 90 a sinusoidal voltage proportional to the sum of the sinusoidal voltages in its primary windings 88 and 89. The voltage in the secondary winding 90 is determined by the expression:

$$U = U_m \cos\frac{\phi(t)}{2} \sin\left[\omega t + \frac{\phi(t)}{2}\right],$$

where

U is the voltage in the secondary winding 90 of the transformer 87, $U_m$ is a value defined by the amplitude of the voltages at the capacitors 68 and 73 and by the transformation ratio of the transformer 87, $\phi(t)$ is the phase shift between the voltages induced in the secondary winding 90 of the transformer 87 by the currents in the primary windings 88 and 89, $\omega$ is the angular frequency of the voltage at the capacitor 68, t is time.

Thus the transformer 87 develops at its secondary winding 90 a sinusoidal voltage having a frequency approximately equal to the relatively high frequency of the signal produced by the oscillator 74 and an amplitude varying as a periodic function of time with a frequency equal to that of the signal at the output of the generator 93. The primary windings 88 and 89 of the transformer 87 are connected in such a way that, when the thyristors 69, 72 and 70, 71 are supplied with pulses simultaneously with the pulse respectively supplied to the thyristors 64, 67 and 65, 66, the voltages induced in the secondary winding 90 of the transformer 87 by the currents in the primary windings 88 and 89 are opposite in phase, with the result that when the signal at the control input of the phase shifting circuit 77 is zero, the voltage in the secondary winding 90 is also zero. Therefore, during variation of the signal at the output of the amplifier 94 the amplitude of the voltage in the secondary winding 90 varies in the range from zero to a certain maximum value proportional to the amplitude of the signal at the output of the amplitifer 94 and determined by the signal supplied to it control input. Because of linear variation of the phase shift between the voltages at the capacitors 68 and 73, the voltage in the secondary winding 90 will vary as a sinusoidal function of time as shown in FIG. 10*h*. The cycle of the amplitude variation (i.e. of the envelope of the voltage in the secondary winding 90) equals the cycle of the signal at the output of the generator 93 (FIG. 9), while the amplitude of this variation (i.e. the amplitude of the voltage envelope) is proportional to the amplitude of the signal at the output of the amplifier 94 and is determined by the signal at its control input.

The signal from the secondary winding 90 of the transformer 87 is applied to the frequency converter 78 which operates as follows.

The input of the pulse shaper 91 is supplied from the secondary winding 90 with a signal proportional to the sum of the voltages produced by the inverters 61 and 62, i.e. to the voltage shown in FIG. 10*h*. The pulse shaper 91 (FIG. 9) develops pulses at its outputs connected through the electronic switches to the control electrodes of the thyristors 79, 84 and 82, 85 when the voltage at the anodes of the thyristors 79 and 84 (at the cathodes of the thyristors 80 and 83) becomes greater than the voltage at the anodes of the thyristors 81 and 86 (at the cathodes of the thyristors 82 and 85) and at its outputs connected to the control electrodes of the thyristors 80, 83 and 81, 86 when the voltage at the anodes of the thyristors 79 and 84 (at the cathodes of the thyristors 80 and 83) becomes smaller than the voltage at the anodes of the thyristors 81 and 86 (at the cathodes of the thyristors 82 and 85). Then, if the switches 99 of the switching device 92 are in a position at which the outputs of the pulse shaper 91 are connected to the control electrodes of the thyristors 79–82, the thyristor bridge composed of these thyristors operates as a full-wave rectifier so that the frequency converter 78 develops at its output a unipolar pulsating voltage the amplitude of which varies in proportion to the amplitude of the voltage at the input of the frequency converter 78. The pulse trains applied to the control electrodes of the thyristors 79–82 are shown in FIG. 10 in which FIG. 10*i* corresponds to the pulses applied to the thyristors 79 and 82 and FIG. 10*j* corresponds to the pulses applied to the thyristors 80 and 81. When the signal at the output of the generator 93 (FIG. 9) becomes zero, i.e. when the envelope of the signal at the input of the frequency converter 78 passes through zero, the signal at the control input of the switching device 92 changes causing the electronic switches 99 to switch to a position at which the outputs of the pulse shaper 91 are connected to the control electrodes of the thyristors 83–86. As a result, the frequency converter 78 develops at its output a unipolar pulsating voltage the amplitude of which varies in proportion to the amplitude of the voltage at the input of the frequency converter 78 but which is opposite in polarity to the voltage developed during operation of the thyristors 79–82. The pulse trains applied to the control electrodes of the thyristors 83–86 are shown in FIG. 10 in which FIG. 10*k* corresponds to the pulses applied to the thyristors 84 and 85 and FIG. 10*l* corresponds to the pulses applied to the thyristors 83 and 86. When the signal at the output of the generator 93 (FIG. 9) again becomes zero, the electronic switches 99 will return to the position at which the outputs of the pulse shaper 91 are connected to the control electrodes of the thyristors 79–82, with the result that the polarity of the pulsating voltage at the output of the frequency converter 78 is reversed again. Thus the frequency converter 78 develops at its output a pulsating voltage having twice the frequency of the voltages at the outputs of the inverters 61 and 62, the envelope of this pulsating voltage varying as a sinusoidal function of time with a frequency equal to that of the signal at the output of the generator 93 as shown in FIG. 10*m*. In this case the amplitude of the sinusoid characterizing variation of the amplitude of the pulsating voltage envelope at the output of the frequency converter 78 (FIG. 9) is proportional to the amplitude of the voltage envelope in the secondary winding 90 of the transformer 87, i.e. is determined by the signal at the control input of the amplifier 94.

The pulses which bring about switching of the electronic switches 99 may be supplied from the output of the bipolar triangular signal generator forming a part of the generator 93.

Thanks to the inductance and capacitance of the line connecting the gaseous discharge lamps 8 to the output of the source 1, the pulsations of the current in the primary windings 6 of the transformers 5 will be smoothed so that the current flowing through the lamps 8 will be practically sinusoidal in form.

The regulation of the current flowing in the primary windings 6 of the transformers 5 is accomplished as follows.

The setting unit 96 is set so that the signal at its output is equal to the signal at the output of the current sensor 95, which corresponds to the assigned current value. With a maximum voltage in the power network and a very small load (e.g. with a minimum number of ignited lamps), the error signal at the output of the comparison circuit 97, and hence the signal at the control input of the amplifier 94, has a minimum value, the amplitude of the signal at the output of the amplifier 94 is very small and the phase shift provided by the phase shifting circuit 77 is subjected to very small changes. In such a case the instants of application of firing pulses to the thyristors 69, 72 and 70, 71 approximately coincide, respectively, with the instants of application of firing pulses to the thyristors 64, 67 and 65, 66, the voltages in the primary windings 88 and 89 of the transformer 87 are shifted in phase by approximately 180° and the voltage at the output of the frequency converter is close to zero.

A decrease in the network voltage or increase in the load leads to a slight decrease in the current flowing through the primary windings 6 of the transformers 5, which is sensed by the current sensor 95 and causes the error signal at the output of the comparison circuit 97 to increase. The change in the error signal is amplified by the amplifier 98 and brings about an increase in the amplitude of the signal at the output of the amplifier 94, and hence a proportional increase in the envelope amplitude of the pulsating voltage at the output of the frequency converter 78 preventing thereby significant increase in the current flowing through the primary windings 6 of the transformers 5. With a minimum network voltage and a maximum number of ignited lamps, the error signal at the output of the comparison circuit 97 and the amplitude of the signal at the output of the amplifier 94 have maximum values at which the amplitude of variation of the phase shift provided by the phase shifting circuit 77 is close to a value corresponding to the half-cycle of the signal at the output of the oscillator 74. In this case the phase shift between the voltages in the primary windings 88 and 89 of the transformer 87 is periodically changed from 180° to a value which is close to zero and the envelope of the pulsating voltage at the output of the frequency converter 78 has a maximum amplitude.

Thus the source 1 of regulated alternating current shown in FIG. 9 is capable of maintaining the current in the primary windings 6 of the transformers 5 at an assigned level under variations in the power network voltage, as well as under drastic changes in the load resistance occurring when the number of the ignited lamps is varied. The accuracy to which the assigned value of current is maintained is determined by the gain of the circuit including the current sensor 95, a comparison circuit 97, an amplifier 98 and by the relationship defining variation of the phase shift provided by the phase shift circuit 77 in response to variation of the signal at the control input of the amplifier 94.

The phase shifting circuit 77 and the pulse shaper 76 may be made so that, when the signal at the control input of the phase shifting circuit 77 is zero, the instants of application of pulses to the control electrodes of the thyristors 69 and 72 coincide with the instants of application of pulses to the control electrodes of the thyristors 65 and 66 and the instants of application of pulses to the control electrodes of the thyristors 70 and 71 coincide with the instants of application of pulses to the control electrodes of the thyristors 64 and 67. In such a case the direction of connection of one of the windings 88 or 89 should be reversed.

Instead of two bridge inverters 61 and 62 shown in FIG. 9 it is possible to use two half-bridge inverters connected in parallel to a direct-current power network in the same way as shown in FIG. 5. In such a case the input of the direct-coupled frequency converter is connected between the junction of the arms of one inverter and the junction of the arms of the other inverter.

The source 1 of regulated alternating current shown in FIG. 11 differs from the circuit shown in FIG. 9 in that the alternating-current voltage producing means, instead of the second thyristor inverter 62 (FIG. 9), comprises an adjustable phase shifting device 100 (FIG. 11) which includes a transformer 101, a bridge rectifier 102, and a magnetic amplifier 103 having its output windings 104 and 105 connected in series with one diagonally opposite pair of junctions of the rectifier 102 to the secondary winding of the transformer 101. The primary winding of the transformer 101, the terminals of which form the input of the phase shifting device 100, is connected across the capacitor 68 of the inverter 61. The other diagonally opposite pair of junctions of the rectifier 102 is connected across the input of the inverter 61. The output of the phase shifting device 100 is connected to the input of the frequency converter 78 through the transformer 87 which has its primary winding 89 connected between the centre tap of the secondary winding of the transformer 101 and the junction between the rectifier 102 and the output windings 104 and 105 of the magnetic amplifier 103. The output of the amplifier 94 is connected to the control winding 106 of the magnetic amplifier 103, the terminals of the control windings 106 forming the control input of the phase shifting device 100.

During operation of the source 1 of regulated alternating current shown in FIG. 11 the primary winding of the transformer 101 of the phase shifting device 100 is supplied with voltage from the output of the inverter 61. Variation of the voltage at the output of the amplifier 94 leads to variation in the biasing of the cores of the magnetic amplifiers 103, which, in turn, leads to variations in the inductance of the output windings 104 and 105 which changes in proportion to the voltage in the control winding 106. The rectifier 102 operates as a resistive element ensuring a partial return of the energy of the current flowing in the secondary winding of the transformer 101 to the input of the source 1. Therefore, a change in the inductance of the output windings 104 and 105 leads to a change in the phase of the voltage between the centre tap of the secondary winding of the transformer 101 and the junction of the rectifier 102 and the output windings 104 and 105, i.e. in the primary winding 89 of the transformer 87. When the signal at the output of the amplifier 94 is zero, the inductance of the output windings 104 and 105 has a maximum value and the phase shift between the voltage in the secondary winding of the transformer 101 and the voltage in the primary winding 89 of the transformer 87 is close to zero. Upon increase in the signal at the output of the amplifier 94 the inductance of the output windings 104 and 105 decreases, whereby the phase shift between the voltage in the secondary winding of the transformer 101 and the voltage in the primary winding 89 increases. If the signal at the output of the amplifier 94 is sufficiently great, this phase shift is close to 180°.

As a result, in the source of regulated alternating current shown in FIG. 11, as in the circuit shown in FIG. 9, the primary winding 89 of the transformer 87 is supplied with voltage shifted in phase with respect to the voltage in its primary winding 88 by an angle which varies in proportion to the signal at the output of the amplifier 94. In other respects the operation of the circuit shown in FIG. 11 does not differ from that of the circuit shown in FIG. 9.

Thus the circuits shown in FIGS. 9 and 11 are capable of producing a low-frequency output current while using commutation elements operating at a relatively high frequency and hence have a small size and weight.

The magnetic amplifier 103 in the circuit shown in FIG. 11 may be substituted by an arrangement consisting of two series-connected inductors one of which is shunted by thyristors connected in antiparallel relation to one another, with the firing angle of the thyristors being changed in accordance with the signal at the output of the amplifier 94.

The signal waveform at the output of the generator 93 may differ from triangular form, provided that the required amplitude factor of the current in the gaseous discharge lamps 8 is ensured. For example, the signal waveform at the output of the generator 93 may be such as to provide at the output of the frequency converter 78 pulsating voltage the envelope of which has a triangular shape and to obtain thereby current in the lamps 8 which is approximately rectangular in shape and thus to reduce pulsations in the light flux and to increase the luminous efficiency of the lamps.

COMMERCIAL APPLICABILITY

The lighting systems designed according to the present invention may be used for lighting industrial buildings, streets, motor roads, stadiums, mines, etc. The source of regulated alternating current is installed at the transformer substation connected to a power line or to a commercial frequency alternating-current power network. The current transformers may be positioned in the lighting fixtures, on the lamp posts or in separate rooms. If the lighting system is used for lighting streets or motor roads, the current transformers may be suspended by insulators from the lamp posts, with the feed wire passing through openings in the transformer cores.

We claim:

1. A lighting system comprising a source of regulated alternating current and gaseous discharge lamps connected to said source through current transformers, whose primary windings are serially connected and coupled to said source, characterized in that said source (1) comprises frequency converting means whose input terminals are connected to an alternating current power network to convert the power network voltage to a regulated alternating current having a frequency at least three times greater than the network voltage frequency, whereas the series-connected primary windings (6) of said current transformers (5) are connected to output terminals of said frequency converting means.

2. A lighting system as claimed in claim 1, characterized in that said frequency converting means comprises a serial circuit which includes two inductors (15, 16) and its one terminal is connected to a three-phase alternating current power network through saturating reactors (17) connected in a star configuration, while its other terminal is connected to the three-phase alternating current power network through an inductive impedance means (19) and a capacitive impedance means (20) connected therewith in series, the serially connected primary windings (6) of the current transformers (5) being connected in parallel to the first inductor (15), and the supply source further comprises a switching circuit connected in parallel to the second inductor (16), a switching circuit control device for opening and closing the switching circuit during each half-cycle of the alternating voltage applied to the second inductor (16), and a current deviation sensing device responsive to a deviation of current flowing through the primary windings (6) of the current transformers (5) from a pre-set value and connected to the switching circuit for adjusting the time periods during which the switching circuit remains in the open and closed positions in response to deviations of the current in primary windings (6) of the current transformers (5) from a pre-set value.

3. A lighting system as claimed in claim 2, characterized in that the primary windings (6) of the current transformers (5) are connected to the first inductor (15) through a matching transformer (33) whose primary winding is formed by the first inductor (15).

4. A lighting system as claimed in claim 3, characterized in that said frequency converting means comprising a rectifier (34) whose input terminals constitute the input terminals of the frequency converting means; two half-bridge thyristor inverters connected in parallel to the output of rectifier (34) and wherein commutation inductors (37, 40, 45, 48) are connected in series with thyristors (35, 38, 43, 46) shunted by diodes (36, 39, 44, 47) connected in antiparallel relation to the thyristors (35, 38, 43, 46), the series-connected primary windings (6) of the current transformers (5) being connected between the point of junction (42) of arms of one of the half-bridge thyristor inverters and the point of junction (50) of arms of the other thyristor inverter, the thyristor firing control means being made so that the firing pulses applied to the thyristors (35, 38) of one of half-bridge thyristor inverters are shifted in phase with respect to the firing pulses applied to the thyristors (43, 46) of the other half-bridge thyristor inverter by an angle corresponding to the signal at the control input of the thyristor firing means; and the frequency converting means further comprises a current deviation sensing device responsive to the deviation of current flowing in the primary windings (6) of the current transformers (5) from a pre-set value and connected to the control input of the thyristor firing means.

5. A lighting system as claimed in claim 1, characterized in that said frequency converting means comprises a first frequency converter (78) which is a direct-coupled frequency converter whose output terminals constitute the output terminals of the frequency converting means and includes two thyristor rectifier circuits connected in anti-parallel relation; a second frequency converter whose input terminals constitute input terminals of the frequency converting means for developing at one of the outputs of the second frequency converting means an alternating current voltage shifted in phase with respect to the voltage developed at its other output by an angle corresponding to the signal at the control input of the second frequency converter, the outputs of the second frequency converter being connected in series to the output of the first frequency converter (78); a signal control device for controlling the signal at the control input of the second frequency converter for periodically varying the voltage at the outputs of the second frequency converter with a frequency which is much smaller than the frequency of those voltages but at least three times greater than the frequency of the voltage at the output of the alternating current power network, and within the range from a certain first limit value at which the voltage input of the first frequency converter (78) is zero to a certain second limit value at which the voltage at the input of the first frequency converter (78) is not zero; a current deviation sensing device responsive to the deviation of current flowing in the primary windings (6) of the current transformer (5) from a pre-set value and connected to the signal control device for controlling the signal at the control input of the second frequency converter to adjust the second limit value of the phase shift in response to deviation of the current in the primary windings (6) of the current transformers (5) from a pre-set value, the thyristor firing means of the rectifier circuits of the first frequency converter (78) being synchronized with the signal control device and by the voltage at the input of the first frequency converter (78) for switching, with a frequency equal to the frequency of the voltage at the input of the first frequency converter (78), the thyristors (79, 80, 81, 82) of one of the rectifier circuits when the phase shift between the voltages at the output of the second frequency converter varies from the first limit value to the second limit value, and the thyristors (83, 84, 85, 86) of the other rectifier circuit when the phase shift between the voltages at the output of the second frequency converter varies from the second value to the first value.

6. A lighting system as claimed in claim 5, characterized in that said second frequency converter comprises a rectifier (63) whose input terminals constitute the input terminals of the second frequency converter, two thyristor inverters (61, 62) connected to the output of the rectifier (63), the outputs of the thyristor inverters (61, 62) respectively constituting the outputs of the second frequeney converter, the thyristor firing means of the thyristor inverters (61, 62) being provided with a control input which constitutes the control input of the second frequency converter and being made so that the firing pulses applied to the thyristors (64, 65, 66, 67) of one inverter (61) are shifted with respect to the firing pulses applied to the thyristors (69, 70, 71, 72) of the other inverter (62) by an angle corresponding to the signal at the control input of the thyristor firing means.

7. A lighting system as claimed in claim 5, characterized in that said second frequency converter comprises a rectifier whose input terminals constitute the input terminals of the second frequency converter, a thyristor inverter (61) connected to the output of the rectifier, and an adjustable phase shifting device (100) having its input connected to the output of the inverter (61), the output of the thyristor inverter (61) constituting one output of the second frequency converter, the control input of the phase shifting device (100) constituting the control input of the second frequency converter, and the output of the phase shifting device constituting the other output of the second frequency converter.

* * * * *